United States Patent [19]

Lisa

[11] Patent Number: 4,693,186

[45] Date of Patent: Sep. 15, 1987

[54] FUNICULAR RAILWAY CAR HAVING COMPARTMENT SUSPENDED ABOVE CHASSIS

[75] Inventor: Alphonse Lisa, Grenoble, France

[73] Assignee: Pomagalski, Fontaine, France

[21] Appl. No.: 903,228

[22] Filed: Sep. 3, 1986

[30] Foreign Application Priority Data

Sep. 9, 1985 [FR] France ..... 85 13449

[51] Int. Cl.[4] ..... B61B 9/00

[52] U.S. Cl. ..... 105/329.1; 104/76; 105/149; 105/149.1

[58] Field of Search ..... 105/329.1, 396, 397, 105/454, 148, 149, 149.1; 104/76, 89, 173.1, 183; 187/10

[56] References Cited

U.S. PATENT DOCUMENTS

| | | | |
|---|---|---|---|
| 3,312,307 | 4/1967 | Camp | 187/10 |
| 3,347,173 | 10/1967 | Carlevaro | 105/149.1 X |
| 3,487,789 | 1/1970 | Garner | 105/149 |

FOREIGN PATENT DOCUMENTS

| | | | |
|---|---|---|---|
| 0070971 | 7/1915 | Austria | 104/146 |
| 0163899 | 8/1949 | Austria | 105/148 |
| 216567 | 8/1961 | Austria | 105/148 |
| 2053907 | 4/1971 | France . | |
| 2057991 | 4/1981 | United Kingdom . | |

*Primary Examiner*—Robert B. Reeves
*Assistant Examiner*—Scott H. Werny
*Attorney, Agent, or Firm*—Parkhurst & Oliff

[57] ABSTRACT

A car of a funicular railway with track sections of different gradients, having a compartment suspended from a hanger arm supported by a carriage. A jack keeps the compartment horizontal, whatever the gradient.

10 Claims, 5 Drawing Figures

FUNICULAR RAILWAY CAR HAVING COMPARTMENT SUSPENDED ABOVE CHASSIS

BACKGROUND OF THE INVENTION

The invention relates to a car, notably of a funicular railway, having a chassis running to and fro on a track laid along a slope and a compartment disposed on said chassis, said compartment having a longitudinal symmetry plane parallel to the axis of the track, as well as a floor and a roof.

A car of the kind mentioned generally speaking comprises a compartment fixed to the chassis, the floor being appreciably horizontal in spite of the inclination of the chassis climbing the gradient. In funicular railways with steep gradients or a long car, the floor is tiered so as to follow the slope better. If the funicular railway track has small gradient variations, the corresponding inclination of the compartment, notably of its floor, is not troublesome, but these variations must be limited. The contours of the ground may impose trajectories having sections with different gradients and the resulting sloping position of the compartment is uncomfortable and dangerous. The possibilities of installing funicular railways are thus limited to certain sites with appreciably constant gradients.

The object of the present invention is to provide a car which can be used on tracks having different gradients.

SUMMARY OF THE INVENTION

The car according to the invention is characterized by the fact that said chassis bears a hanger arm at the free end of which said compartment is suspended by a central articulation spindle perpendicular to said longitudinal plane to allow free movement of the compartment in said longitudinal plane and to hold the floor in a horizontal position independently from the gradient being climbed by the car.

Suspending the compartment from its center makes the compartment tend to place itself automatically in the horizontal position or more exactly in a position aligning the center of gravity with the vertical line passing through the suspension point. When an unequal passenger or load distribution occurs, the compartment slopes, but this slope is limited, the balanced position being stable.

According to an important feature of the invention, the hanger arm is disposed in the middle of the compartment to free the side faces equipped with access doors and windows. The hanger arm movement area is protected by partitions, which bound an internal compartment or housing, these partitions being able to be partially or totally transparent. In the case of a funicular railway, the chassis is a carriage with sheaves or wheels, which run on a railway and are hauled by a hauling rope, but it is clear that the invention can be applied to other types of installations or tracks. The hanger arm may be a straight pole fixed by its base to the chassis and bearing at its top a transverse articulation spindle of the compartment. The length of the chassis or carriage is close to that of the compartment to ensure a good stability and the fixing point of the hanger arm on the chassis is advantageously offset towards the slope side. In a preferred embodiment, the hanger arm is swan-necked with a convex part facing the slope, so as to bring it closer to the edge of the compartment, towards which the hanger arm moves when the chassis is inclined climbing the slope. The space taken up by the hanger arm inside the compartment is thus reduced to a simple groove on the uphill side in the longitudinal plane of the compartment. The width of the hanger arm and of the housing in which the hanger arm passes through the compartment is a fraction of the width of the compartment and the corresponding reduction in the volume of the passenger compartment is small. This housing, located in the middle of the compartment, does not hinder passengers embarking and disembarking or access to the windows, notably on the downhill side.

The oscillations of the compartment are checked by dampers and/or according to an important feature of the invention, they are controlled by a motor designed to keep the floor in the horizontal position. The motor is for example a hydraulic or electric jack, fitted between the chassis and the compartment and this jack is controlled by a regulation unit piloted by a compartment gradient detector. This automatic regulation keeps the compartment horizontal, the jack supplying only a limited effort to compensate an unbalance, due to a poor load distribution. The accuracy of this control device can be low, slight inclinations of the compartment being tolerable. The jack and its control system are preferably housed in the compartment through which the hanger arm passes. A safety system, for example detecting an excessive compartment inclination, disconnects the control, for example by discharging the jack, to automatically re-establish the position imposed by the weight of the compartment and of the load.

BRIEF DESCRIPTION OF THE DRAWINGS

Other advantages and characteristics will become more clearly apparent from the following description of various embodiments of the invention, given as examples only and represented by the accompanying drawings, in which.

DETAILED DESCRIPTION OF THE PREFERRED EMBODIMENT

Figure 1:
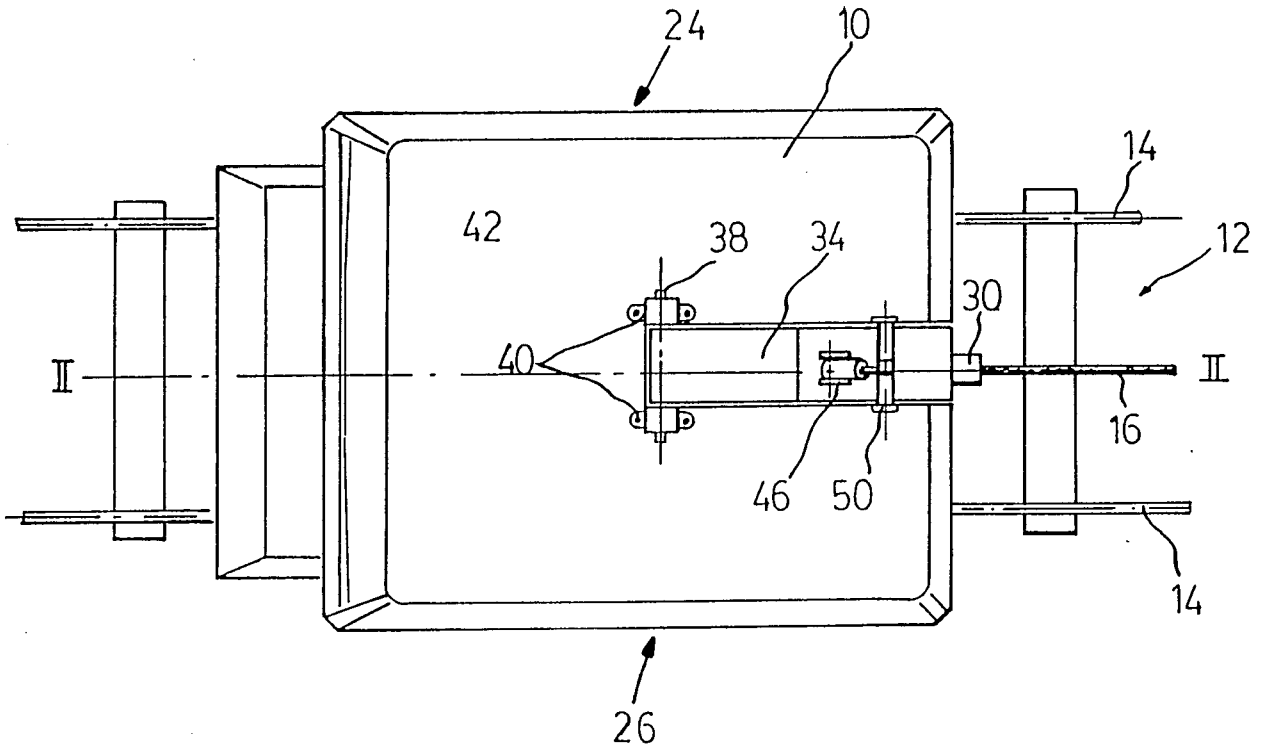
FIG. 1 is a plan view of a funicular railway car according to the invention.

In the figures, a car 10 of a funicular railway moves on a track 12 with rails 14 and a hauling rope 16 driven by a drive station, which is not shown. The funicular railway generally speaking comprises a single track with a branch in the middle for an up car and a down car to cross over, but the invention can be applied to a funicular railway with two independent tracks or with a single car or a track with a different structure. The car comprises a chassis 18 bearing wheels 20 which run on the rails 14, the assembly forming a carriage supporting a compartment 22 for transporting passengers or possibly other loads. The compartment 22, of a general parallelipipedic shape, comprises on one or both of the large lateral faces 24, 26, parallel to the track 12, access doors 28, the compartment faces being made up by window-panes. The chassis 18, in the form of a rectangular plateau of small height, bears on its uphill part, facing the uphill side of the slope, an anchoring point 30 of the hauling rope 16, which extends along the track 12. The compartment 22 is located above the chassis 18 being suspended from a hanger arm 34, whose base is rigidly fixed to the chassis 18 and whose top 36 bears a horizontal shaft 38, perpendicular to the longitudinal symmetry plane of the compartment corresponding to the direction of the track 12. The shaft 38 is rotatingly mounted in two bearings 40 fixed to the compartment 22 in the center of the roof 42. The hanger arm 34 in a rectangular section housing extends in the longitudinal vertical symmetry plane of the compartment 22 passing through a groove 44 located in the middle and over the whole height of the compartment 22 on the uphill side of the latter. The width of the hanger arm 34 and consequently that of the groove 44, which is slightly greater to give the hanger arm 34 clearance, are a fraction of the width of the compartment 22. The height of the hanger arm 34 is sufficient to support the compartment 22 at a distance "d" from the chassis 18 allowing oscillation of the compartment 22. The swan-neck shaped hanger arm 34 is convex on the uphill side and the fixing point to the chassis 18 is offset towards the uphill part of the chassis 18.

Figure 2:
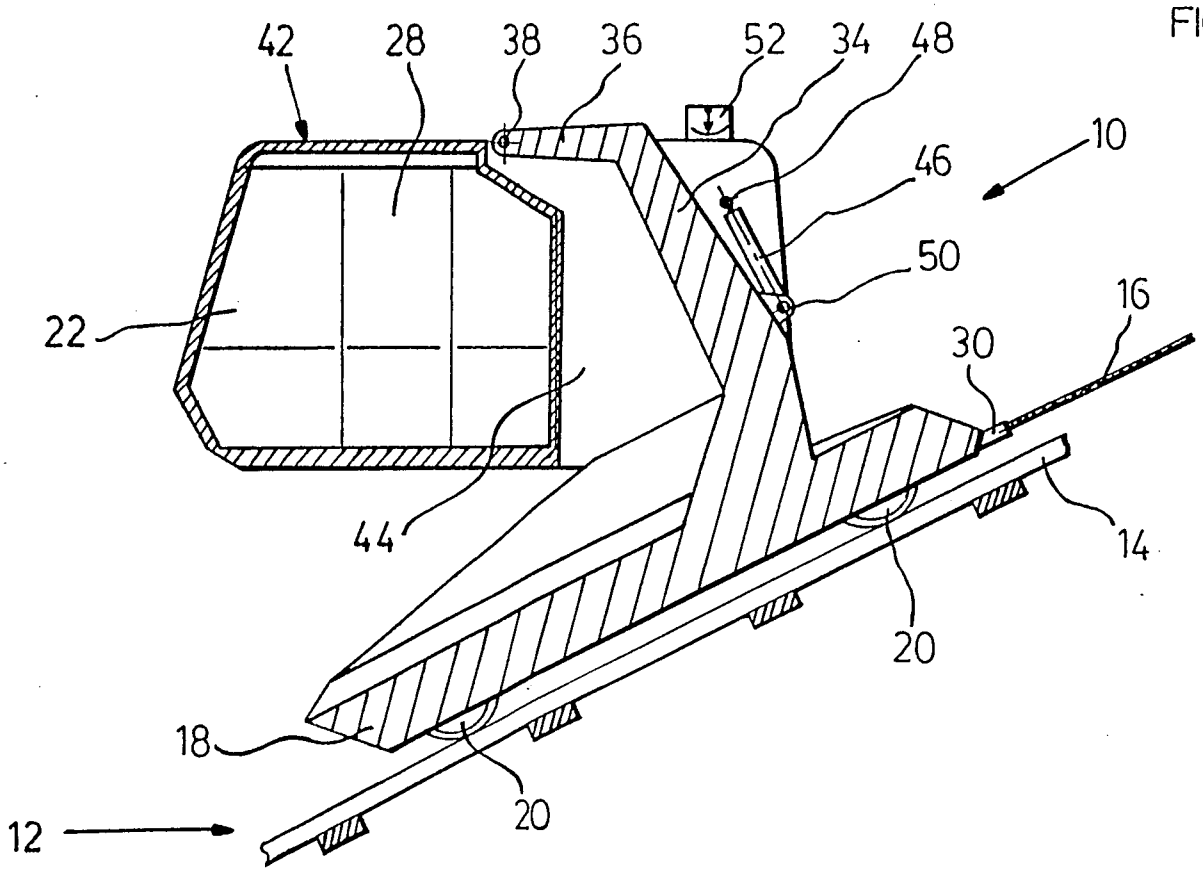
FIG. 2 is a cross-section according to the line II—II of FIG. 1.
Figure 3:
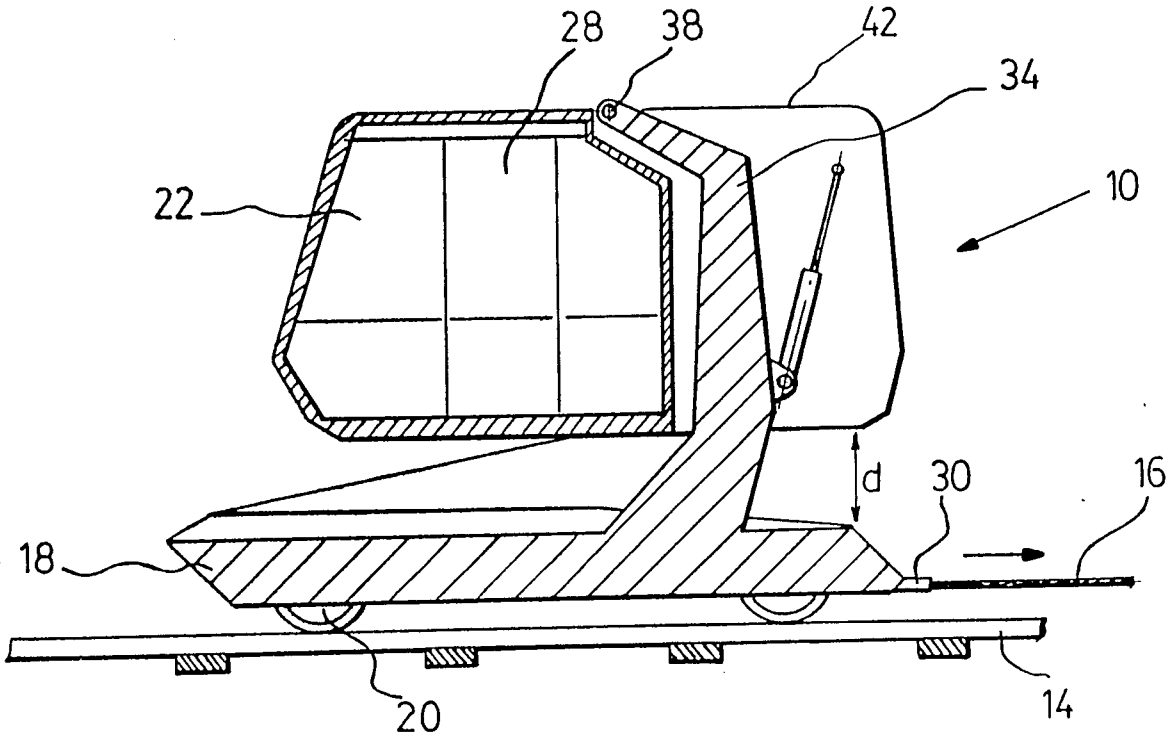
FIG. 3 is a similar view to that of FIG. 1, showing the car on a horizontal track.

It can easily be seen that the weight of the compartment 22 makes the latter swing around the shaft 38, to bring the center of gravity to the vertical line passing through the shaft 38. This position is a stable balanced one. In the case of a uniform load distribution, the compartment 22, notably its floor, remains horizontal, however much the chassis 18 is inclined, that is to say whatever the gradient of the track 12. The swan-neck shape limits the depth of the groove 44 inside the passenger compartment 22, this depth naturally being adapted to the maximum gradient and to the variations of the funicular railway gradient. FIG. 2 represents the car 10 on a section of maximum gradient, FIG. 3 showing a horizontal section. The length of the chassis 18 is sufficient to ensure a good stable position on all the sections of the funicular railway. By increasing the curvature of the hanger arm 34, it is possible to almost do away with the groove 44 in installations with a steep gradient and limited gradient variations, the hanger arm extending outside and uphill from the compartment. The groove 44 has the advantage of concealing the hanger arm and of giving the car 10 an undeniable aesthetic appearance. The presence of the groove 44 or more exactly of the housing bounding the groove 44 inside the compartment does not hinder access to the car at all, this compartment being able to comprise window-panes if an opaque partition is not suitable. The suspension mode of the compartment 22 does not require any modification to the terminal platforms which can extend along the side faces with small clearance.

The balance of the compartment 22 is improved by increasing the distance between the center of gravity and the suspension point 38, notably by shifting the latter above and away from the roof.

This solution requires a hanger arm 34 jutting out from the compartment which is not very aesthetical. In the embodiment illustrated by the figures, a jack 46, which may be hydraulic, electric or suchlike, is anchored both at 48 to the compartment 22, and at 50 to the hanger arm 34 to vary the position of the compartment 22 in relation to that of the hanger arm 34, that is to say of the chassis 18. The jack 46 counteracts a poor load distribution, for example a concentration of passengers at the front or rear of the compartment 22, its operating control being of course automatic. The jack 46 supplies a relatively low effort and its operation can be slow. The control device is simplified and comprises, for example, a gradient detector 52 of the compartment 22, which supplies the jack 46 to re-establish and maintain the horizontal position. A safety system can put the jack 46 out of operation when the gradient of the compartment is too steep, for example by discharging the hydraulic jack, to compensate for a failure of this control device. The compartment 22 in this case takes the gradient corresponding to the position of the center of gravity, this gradient always being limited. The use of a compartment suspension, according to the invention, simplifies the mechanism and compartment position control.

The operating mode is apparent from the above description. When the car 10 hauled by the rope 16 climbs a slope, the floor of the compartment 22 is held horizontal by the jack 46, independently from the gradient and variations in gradient in the course of the run. The track 12 of the funicular railway can thus follow the contours of the ground and among other things comprise a horizontal departure and arrival terminal, simplifying the infrastructure.

Figure 4:
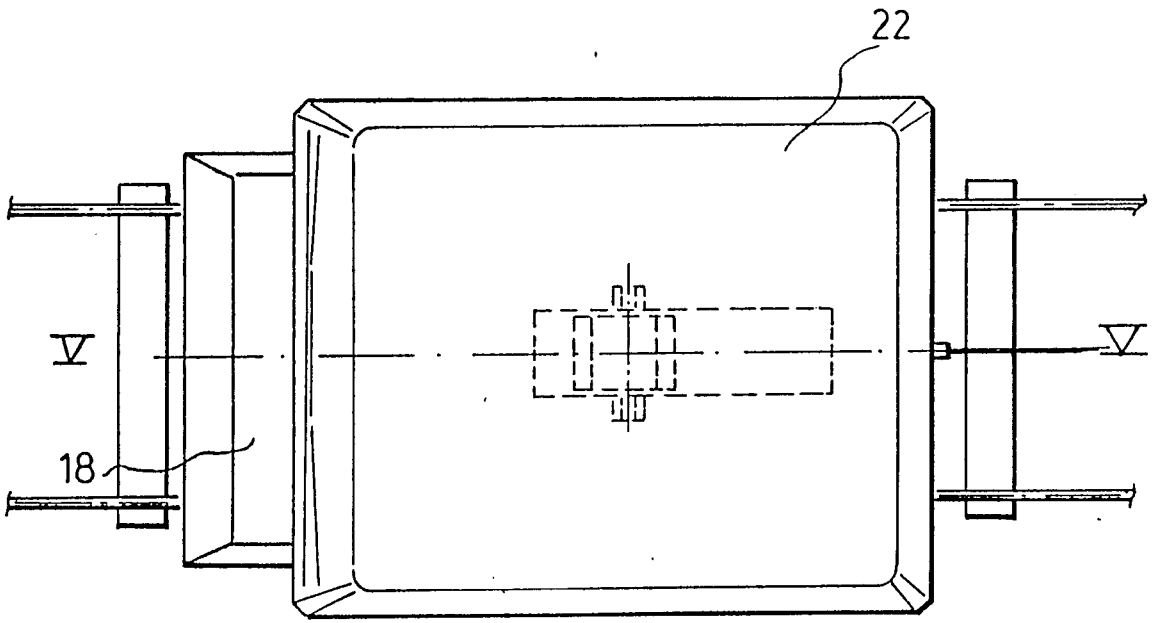
FIGS. 4 and 5 are similar views to those of FIGS. 1 and 2, illustrating an alternative embodiment.
Figure 5:
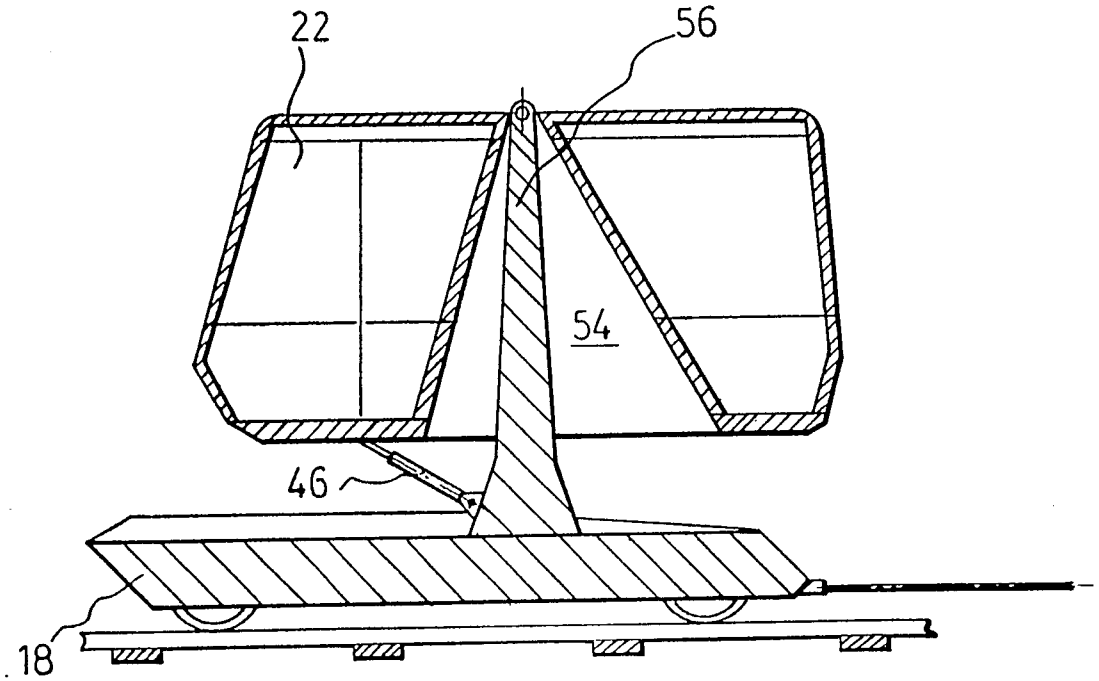

FIGS. 4 and 5 illustrate an alternative embodiment, the same reference numbers designating similar or identical parts to those in FIGS. 1 to 3. It can be seen that the hanger arm, in the form of a straight pole 56 perpendicular to the chassis 18, passes through the floor of the compartment 22 and extends in a wedge-shaped housing 54, located in the middle of the compartment. The angle at the top of the triangular housing 54 corresponds to the gradient variations of the funicular railway and the slope of the sides of the triangular housing corresponds to the maximum and minimum gradients. Operation is of course identical and the car can be equipped with a jack control device 46.

The car advantageously comprises the usual equipment, such as dampers, safety systems and suchlike. The funicular railway described has a rail track, but using a track for pneumatic or other wheels would not depart from the spirit of the invention.

What I claim is:

1. A car, notably of a funicular railway, having a chassis running above a track laid along a slope having a gradient, and a compartment disposed on said chassis, said compartment having a longitudinal symmetry plane parallel to a longitudinal axis of the track, as well as a floor and a roof, said chassis comprising a hanger arm having a free end and a central articulation spindle supported by said free end to which said compartment is suspended, said central articulation spindle extending perpendicularly to said longitudinal plane to allow free movement of the compartment in said longitudinal plane and to hold the floor in a horizontal position independently from the gradient being climbed by the car.

2. A car according the claim 1, wherein said hanger arm is disposed in said longitudinal plane, said floor having an opening in the form of a slit or longitudinal groove extending through the compartment of the car, said hanger arm passing through said opening.

3. A car according to claim 2, wherein said compartment comprises an internal housing bounding the movement area of the hanger arm inside the car.

4. A car according to claim 1, wherein said compartment suspension spindle is located at the level of the roof at a height from said chassis to leave between the chassis and the floor, in the horizontal position of the car, a sufficient space "d" to clear the compartment.

5. A car according to claim 1, wherein said hanger arm is formed by a straight pole appreciably perpendicular to said chassis, and fixed to the chassis at a fixing point, said fixing point being offset towards an uphill side of the chassis, the term uphill being defined in relation to the gradient of the slope of the track.

6. A car according to claim 1, wherein said hanger arm is swan-necked in shape with a convex part facing towards the uphill side of the chassis, the term uphill being defined in relation to the slope of a track, the fixing point of the swan-neck hanger arm to the chassis being offset towards a uphill side.

7. A car according to claim 6, wherein said compartment comprises on the uphill side a groove disposed in the longitudinal symmetry plane, said hanger arm passing through and moving in said groove.

8. A car according to claim 1, comprising a motor, notably a hydraulic jack means, fitted between the chassis and the compartment and a control device of said motor to swivel the compartment in relation to the chassis when a variation in the inclination of the chassis occurs when the car is travelling along the track and to keep the floor of the compartment appreciably horizontal.

9. A car according to claim 8, comprising a safety device to automatically put said motor out of operation when the inclination of the compartment exceeds a preset threshold.

10. A car according to claim 1, wherein said chassis comprises a carriage which runs on a railway being hauled by a hauling rope, said compartment comprising loading and unloading openings located on a face of the compartment parallel to said longitudinal plane.

* * * * *